US006571566B1

(12) United States Patent
Temple et al.

(10) Patent No.: US 6,571,566 B1
(45) Date of Patent: Jun. 3, 2003

(54) METHOD OF DETERMINING REFRIGERANT CHARGE LEVEL IN A SPACE TEMPERATURE CONDITIONING SYSTEM

(75) Inventors: Keith A. Temple, Pittsburgh, PA (US); Oved W. Hanson, Carrollton, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 0 days.

(21) Appl. No.: 10/114,191

(22) Filed: Apr. 2, 2002

(51) Int. Cl.[7] ..... F25B 49/02
(52) U.S. Cl. ..... 62/129; 62/149; 62/127
(58) Field of Search ..... 62/149, 126, 127, 62/129, 208, 209, 125

(56) References Cited

U.S. PATENT DOCUMENTS

| | | | | |
|---|---|---|---|---|
| 4,381,549 A | | 4/1983 | Stamp, Jr. et al. | |
| 4,463,576 A | | 8/1984 | Burnett et al. | |
| 4,677,830 A | | 7/1987 | Sumikawa et al. | |
| 4,745,765 A | | 5/1988 | Pettitt | |
| 4,829,777 A | * | 5/1989 | Matsuoka et al. | 62/149 |
| 5,009,074 A | | 4/1991 | Goubeaux et al. | |
| 5,152,152 A | | 10/1992 | Brickner et al. | |
| 5,186,014 A | | 2/1993 | Runk | |
| 5,239,865 A | | 8/1993 | Salzer et al. | |
| 5,301,514 A | | 4/1994 | Bessler | |
| 5,457,965 A | | 10/1995 | Blair et al. | |
| 5,560,213 A | | 10/1996 | Wieszt | |
| 5,713,213 A | | 2/1998 | Nobuta et al. | |
| 5,987,903 A | | 11/1999 | Bathla | |
| 6,101,820 A | | 8/2000 | Cheballah | |
| 6,463,747 B1 | * | 10/2002 | Temple | 62/129 |

* cited by examiner

*Primary Examiner*—Chen Wen Jiang
(74) *Attorney, Agent, or Firm*—W. Kirk McCord

(57) ABSTRACT

In accordance with the present invention, a method of determining refrigerant charge level in a space temperature conditioning system includes the steps of establishing a relationship between at least one selected system operating parameter and refrigerant charge level, independent of ambient temperature conditions; measuring the selected parameter(s) while the system is in operation; and using the established relationship and the measured parameter(s) to determine the refrigerant charge level. In one embodiment of the invention, both condenser subcooling and evaporator superheat parameters are measured and the predetermined relationship between charge level and each of these parameters is used to determine the actual refrigerant charge level.

20 Claims, 6 Drawing Sheets

METHOD OF DETERMINING REFRIGERANT CHARGE LEVEL IN A SPACE TEMPERATURE CONDITIONING SYSTEM

DESCRIPTION

1. Field of Invention

This invention relates generally to space temperature conditioning systems and in particular to a new and improved method of determining refrigerant charge level in a space temperature conditioning system.

2. Background Art

Space temperature conditioning systems of the type having a refrigerant as a heat transfer medium are well-known in the art. It is important that such systems have a proper charge of refrigerant in order to function properly. Various methods of determining refrigerant charge level are known in the art. Most of these prior art methods provide only a qualitative determination of whether the charge level is below or above acceptable limits or require inputs from multiple sensors, including ambient temperature and humidity sensors, in order to determine refrigerant charge level, which increases the cost and complexity of the system. Examples of such prior art refrigerant charge level determination methods are shown in U.S. Pat. Nos. 4,381,549; 4,677,830; 5,239,865; 5,987,903; and 6,101,820.

There is, therefore, a need for an improved method of determining refrigerant charge level in a space temperature conditioning system. There is also a need for a method of determining refrigerant charge level in a space temperature conditioning system that is both relatively inexpensive and reliable under a wide range of ambient temperature conditions.

SUMMARY OF INVENTION

In accordance with the present invention, a method for determining refrigerant charge level in a space temperature conditioning system is provided. The method is comprised of the following steps: (a) establishing a relationship between at least one system operating parameter and refrigerant charge level, independent of ambient temperature conditions; (b) operating the space temperature conditioning system; (c) measuring the operating parameter(s) while the system is in operation; and (d) determining refrigerant charge level based on the established relationship in response to the measuring step.

In accordance with one embodiment of the invention, the establishing step comprises: (i) operating the system; (ii) measuring the operating parameter(s) under a plurality of ambient temperature conditions for each of a plurality of known refrigerant charge levels; and (iii) correlating the measured values of the operating parameter(s) to establish a relationship between refrigerant charge level and the operating parameter(s), independent of the ambient temperature conditions.

In accordance with another embodiment of the invention, the system is a space temperature conditioning system of the type having a condenser, an evaporator and a compressor for circulating a vapor compression refrigerant between the evaporator and the condenser and the at least one system operating parameter includes refrigerant subcooling.

In accordance with yet another embodiment of the invention, the at least one operating parameter includes refrigerant subcooling and refrigerant superheat.

In accordance with still another embodiment of the invention, the at least one operating parameter includes refrigerant subcooling and refrigerant pressure at at least one selected location in the system.

In accordance with the preferred embodiment of the invention, the at least one system operating parameter includes refrigerant subcooling, refrigerant superheat, liquid refrigerant pressure on a discharge side of the condenser and vapor refrigerant pressure on a suction side of the compressor. These four parameters are measured while the system is operating at a relatively steady-state condition and the measured values of the parameters are used to determine refrigerant charge level based on the predetermined relationship between charge level and each of these parameters. A human-detectable indication is provided regarding whether the charge level is within acceptable limits and if it is not within acceptable limits, the amount of the undercharge or overcharge condition is indicated.

BEST MODE FOR CARRYING OUT THE INVENTION

The best mode for carrying out the invention is described hereinbelow with reference to the accompanying drawings. The drawings are not necessarily to scale and in some instances proportions may have been exaggerated in order to more clearly depict certain features of the invention.

Figure 1:
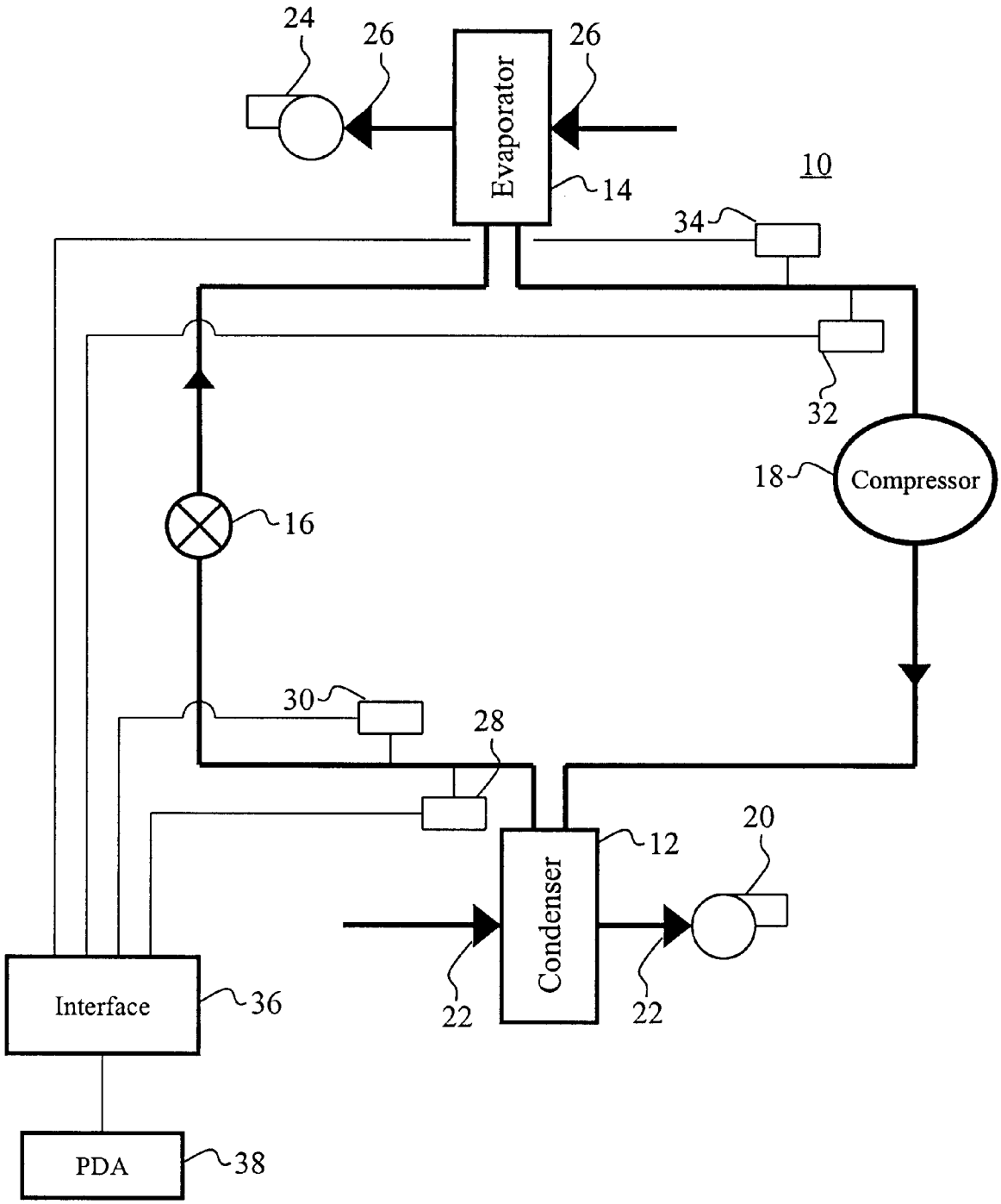
FIG. 1 is a block diagram of a space temperature conditioning system embodying the present invention.

Referring to FIG. 1, a space temperature conditioning system 10 of the type normally installed in a residence or commercial building is comprised of a condenser 12, an evaporator 14, an expansion device 16 (which may be either a fixed expansion device, such as an orifice, or a controllable expansion device, such as a thermal expansion valve) and a compressor 18. Compressor 18 is operative to circulate a vapor compression refrigerant between condenser 12 and evaporator 14 and to compress the vapor refrigerant before it enters condenser 12. Condenser 12, which is in heat exchange relationship with outdoor ambient air, is operative to substantially condense the vapor refrigerant. Evaporator 14, which is in heat exchange relationship with the indoor air to be cooled, is operative to substantially evaporate the refrigerant. Expansion device 16 facilitates evaporation of the refrigerant by reducing the pressure thereof before the refrigerant enters evaporator 14. The heat absorbed by the refrigerant during evaporation cools the air passing through evaporator 14. The cooled air is supplied to an indoor conditioned space via an air supply duct (not shown). Although system 10 is described herein as a conventional air conditioning (cooling) system, one skilled in the art will recognize that 10 may also be configured as a heat pump system to provide both heating and cooling, by adding a reversing valve (not shown) so that the outdoor heat exchanger (condenser 12 in FIG. 1) functions as an evaporator in the heating mode and the indoor heat exchanger (evaporator 14 in FIG. 1) functions as a condenser in the heating mode.

In addition to the primary components of system 10 described hereinabove, condenser 12 has a fan 20 operatively associated therewith, which moves air (typically outdoor ambient air) across condenser 12, as indicated by arrows 22, to cool the refrigerant in condenser 12 and facilitate condensation thereof. Similarly, evaporator 14 has a fan 24 operatively associated therewith for moving indoor air to be cooled across evaporator 14, as indicated by arrows 26.

System 10 may also include various temperature and pressure sensors of the types normally used in space temperature conditioning systems. Temperature sensor 28 senses the temperature of the liquid refrigerant on a discharge side of condenser 12 between condenser 12 and expansion device 16 (said temperature being hereinafter referred to as the "liquid refrigerant temperature"). Pressure sensor 30 senses the pressure of the liquid refrigerant on the discharge side of condenser 12 between condenser 12 and expansion device 16 (said pressure being hereinafter referred to as the "liquid refrigerant pressure"). Temperature sensor 32 senses the temperature of the vapor refrigerant on a suction side of compressor 18 between evaporator 14 and compressor 18 (said temperature being hereinafter referred to as the "vapor refrigerant temperature"). Pressure sensor 34 senses the pressure of the vapor refrigerant on the suction side of compressor 18 between evaporator 14 and compressor 18 (said pressure being hereinafter referred to as the "vapor refrigerant pressure"). Sensors 28 and 30 are preferably located at a liquid service valve (not shown) between condenser 12 and expansion device 16 or, alternatively, at an inlet to expansion device 16. Sensors 32 and 34 are preferably located at a suction service valve (not shown) between evaporator 14 and compressor 18, but alternate locations are at an outlet from evaporator 14 or at an outlet from compressor 18.

The temperature measurements from sensors 28, 32 and the pressure measurements from sensors 30, 34 are transmitted to an interface module 36, which provides electrical power to sensors 28, 30, 32, 34 and converts the analog data signals to digital signals for processing by a personal digital assistant (PDA) 38. PDA 38 is programmed to perform the necessary calculations (including subcooling and superheat) to determine refrigerant charge level and to provide a human-detectable output to a service technician.

Figure 2:
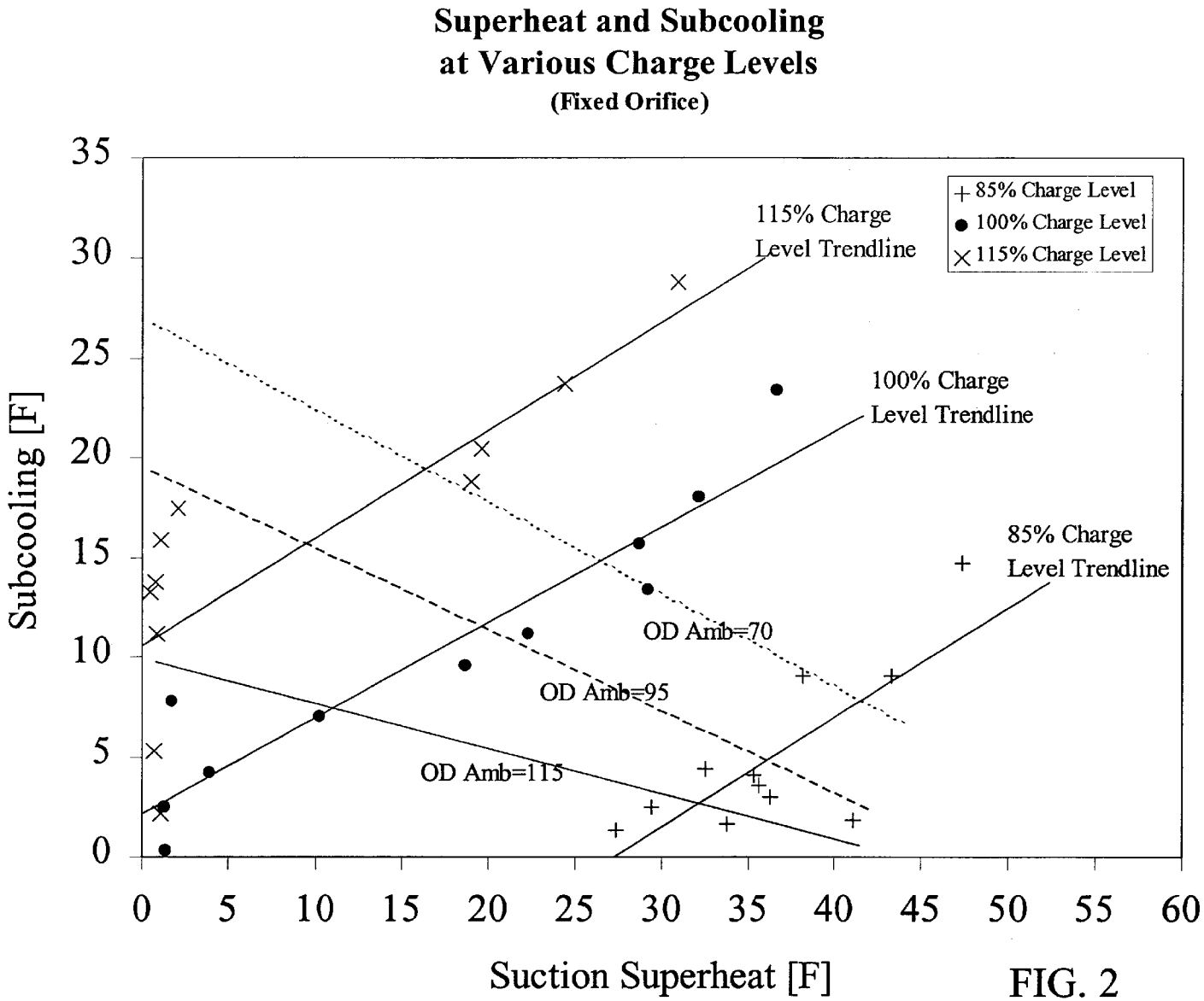
FIG. 2 is a graph of the relationship between the subcooling and superheat values at various known refrigerant charge levels and under different ambient temperature conditions for a space temperature conditioning system having a fixed expansion device.

Referring now to FIG. 2, refrigerant charge level is a function of condenser subcooling (SC), evaporator superheat (SH), liquid refrigerant pressure ($P_{liqv}$) and vapor refrigerant pressure ($P_{suct}$). The subcooling value SC is determined by subtracting the liquid refrigerant temperature measured by sensor 28 ($T_{liqv}$) from the liquid refrigerant saturation temperature ($T_{satl}$) on the discharge side of condenser 12, according to the following equation (1):

$$SC=T_{satl}-T_{liqv} \tag{1}$$

The superheat value (SH) is determined by subtracting the vapor refrigerant saturation temperature ($T_{satv}$) on the suction side of compressor 18 from the vapor refrigerant temperature ($T_{suct}$) measured by temperature sensor 32, according to the following equation (2):

$$SH=T_{suct}-T_{satv} \tag{2}$$

Each of the liquid refrigerant saturation temperature ($T_{satl}$) and the vapor refrigerant saturation temperature ($T_{satv}$) is a function of the corresponding refrigerant pressure. For example, the saturation temperature for R22 refrigerant may be determined according to the following equation (3):

$$T_{sat} = -149.9 - 0.04144906 \cdot P + 7.533 \cdot P^{0.5} + 27.62 \cdot \ln(P) + \frac{22.88}{P^{0.5}} \tag{3}$$

In equation (3) $T_{sat}$ can be either the liquid refrigerant saturation temperature $T_{satl}$ or the vapor refrigerant saturation temperature $T_{satv}$. For example, if $T_{sat}$ represents the liquid refrigerant saturation temperature $T_{satl}$, then the pressure P in equation (3) corresponds to the liquid refrigerant pressure $P_{liqv}$ measured by sensor 30. On the other hand, if $T_{sat}$ represents the vapor refrigerant saturation temperature $T_{satv}$, then the pressure P in equation (3) corresponds to the vapor refrigerant pressure $P_{suct}$ measured by sensor 34.

In accordance with the present invention, inputs from temperature sensors 28, 32 and pressure sensors 30, 34 are used to establish baseline data for determining refrigerant charge level. To establish this baseline data, system 10 is operated at various known refrigerant charge levels and under various known ambient temperature conditions, and the subcooling SC and superheat SH values are determined in accordance with equations (1), (2) and (3) and stored in PDA 38.

FIG. 2 shows a relationship between subcooling and superheat plotted on a graph wherein the subcooling values are shown on the ordinate and the superheat values are shown on the abscissa. FIG. 2 shows data plotted for three different refrigerant charge levels (85%, 100% and 115%) and for eleven different ambient temperature conditions for each charge level, so that each charge level has eleven different data points associated therewith. Charge level 100% represents the normal or desired charge level. The following Table I shows the eleven different ambient temperature conditions for which data was taken.

TABLE I

| ID Amb (DB) ° F. | ID Amb (WB) ° F. | OD Amb (DB) ° F. |
|---|---|---|
| 65 | 51 | 70 |
| 65 | 51 | 95 |
| 65 | 51 | 115 |
| 80 | 62 | 95 |
| 80 | 67 | 70 |
| 80 | 67 | 95 |
| 80 | 67 | 115 |
| 80 | 71 | 95 |
| 95 | 84 | 70 |
| 95 | 84 | 95 |
| 95 | 84 | 115 |

The first column in Table I represents the indoor ambient dry bulb temperature, the middle column represents the indoor ambient wet bulb temperature and the right column represents the outdoor ambient dry bulb temperature. The data shown in FIG. 2 is for an air conditioning system 10 in which expansion device 16 is a fixed orifice. The data in FIG. 2 shows an approximately linear relationship between subcooling and superheat for three different refrigerant charge levels, as indicated by the three positive-sloped lines. Further, the three negative-sloped lines illustrate how the relationship between subcooling and superheat is affected by outdoor ambient temperature conditions. For example, when the outdoor ambient dry bulb temperature (OD Amb) temperature 70° F., the subcooling value is less for a given superheat value than when the outdoor ambient dry bulb temperature is 95° F. The subcooling value is even less for the same given superheat value when the outdoor ambient dry bulb temperature is 115° F. Therefore, by determining the relationship between subcooling and superheat under various ambient temperature conditions for a particular refrigerant charge level, the affects of both indoor and outdoor ambient temperature can be essentially eliminated in predicting the refrigerant charge level, which reduces the complexity and cost of the charge level determination method.

Figure 3:
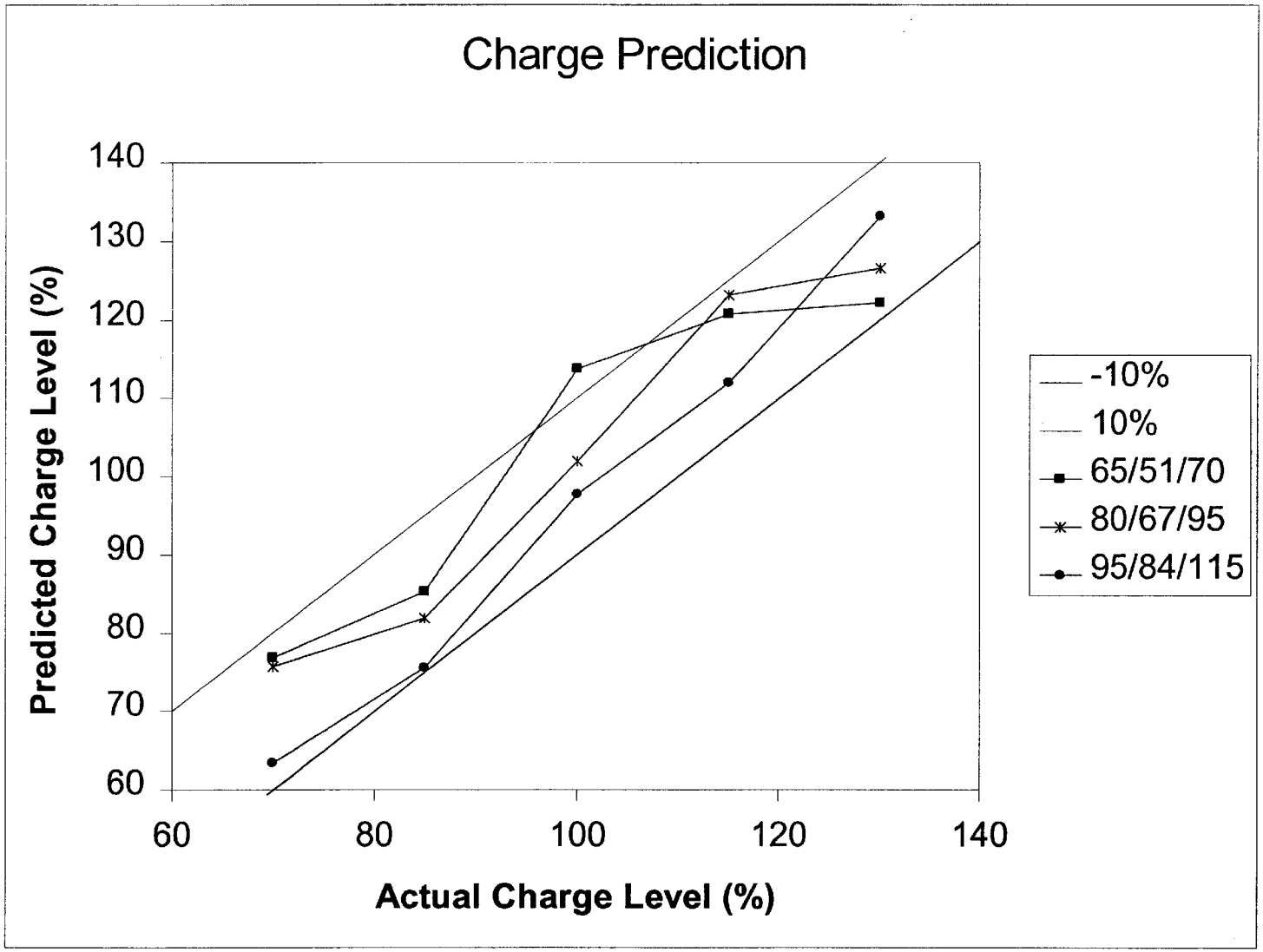
FIG. 3 is a graph of predicted refrigerant charge level versus actual charge level, based on the data of FIG. 2, under different ambient temperature conditions.

Referring also to FIG. 3, the predicted refrigerant charge level, as determined from the data of FIG. 2, is plotted against the known refrigerant charge level for three different ambient temperature conditions, to validate predicted charge level. FIG. 3 shows that the predicted charge level is within 10% of the actual charge level over a range of charge levels from about 70% to 130%. The three ambient conditions for which data is plotted in FIG. 3 correspond to (a) 65° F. indoor dry bulb temperature/51° F. indoor wet bulb temperature/70° F. outdoor dry bulb temperature; (2) 80° F. indoor dry bulb temperature/67° F. indoor wet bulb temperature/95° F. outdoor dry bulb temperature; and (3) 95° F. indoor dry bulb temperature/84° F. indoor wet bulb temperature/115° F. outdoor dry bulb temperature.

The baseline data shows that over a range of charge levels between 70% and 130% relative to normal charge level, refrigerant charge level (CL) is a function of subcooling, superheat, liquid refrigerant pressure and vapor refrigerant pressure. For example, the function can be represented by a first order linear approximation represented by the following equation (4), where a, b, c, d and e are coefficients based on the particular system 10:

$$CL=a\cdot SC+b\cdot SH+c+d\cdot P_{liqv}+e\cdot P_{suct} \quad (4)$$

PDA 38 is preferably equipped with a standard curve fitting program to determine the values of coefficients a, b, c, d and e, using the baseline data of FIG. 2 and the measured pressures (liquid refrigerant pressure and vapor refrigerant pressure).

Figure 4:
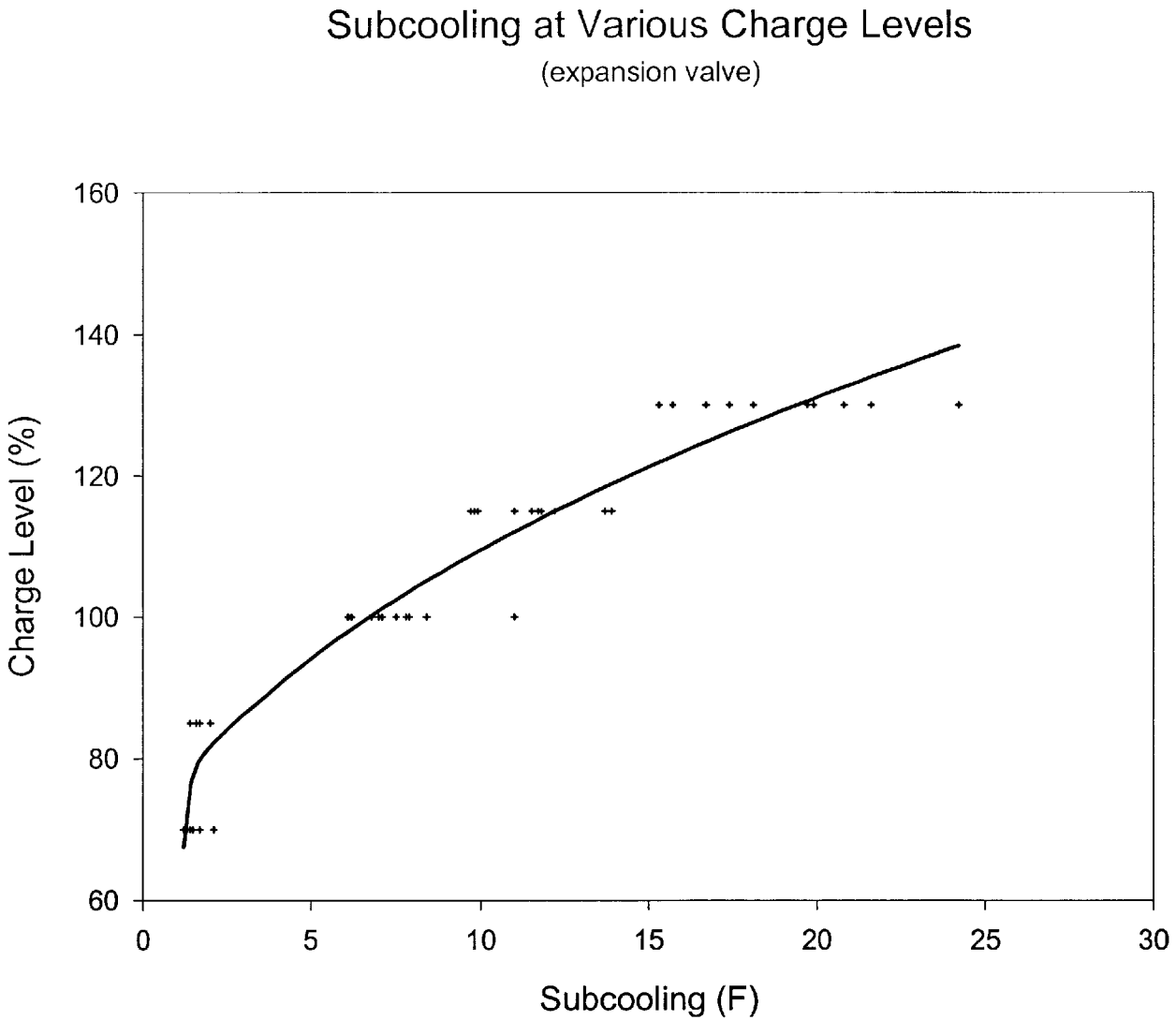
FIG. 4 is a graph of subcooling versus refrigerant charge level under different ambient temperature conditions for a space temperature conditioning system having a thermal expansion valve.

Referring now to FIG. 4, if expansion device 16 is a thermal expansion valve, the superheat value usually is not needed to determine charge level so that charge level CL is a function of subcooling, liquid refrigerant pressure and vapor refrigerant pressure. For example, the function can be represented by a first order linear approximation as set forth in the following equation (5), where a, c, d and e are coefficients based on the particular system 10:

$$CL=a\cdot SC+c+d\cdot P_{liqv}+e\cdot P_{suct} \quad (5)$$

FIG. 4 shows subcooling plotted against refrigerant charge level for a system 10 having a thermal expansion valve. The data was measured for five different charge levels (70%, 85%, 100%, 115% and 130%) under eleven different ambient temperature conditions (the same ambient temperature conditions shown in Table I). The data shows that there is an approximate linear relationship between charge level and subcooling, but that there is a greater deviation from the linear approximation at the higher charge levels. The curve fitting program determines the values of the coefficients a, c, d and e, using the baseline data of FIG. 4 and the measured pressures (liquid refrigerant pressure and vapor refrigerant pressure).

Figure 5:
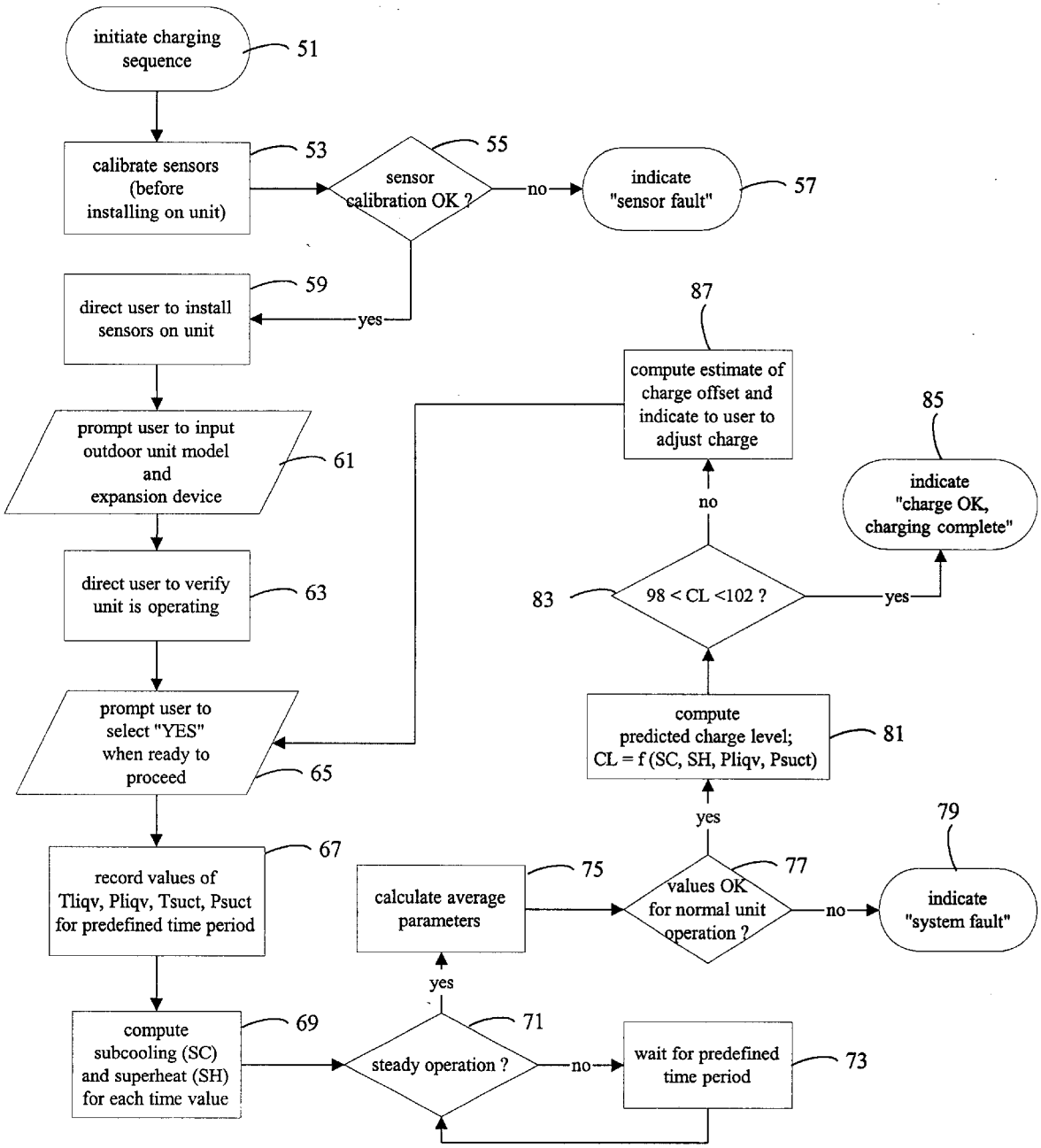
FIG. 5 is a flow diagram of a refrigerant charge level determination algorithm in accordance with the present invention.

Referring now to FIG. 5, the refrigerant charge level determination algorithm in accordance with the present invention is shown. The algorithm will be described with reference to a system 10 having a fixed orifice expansion device. PDA 38 preferably includes a microcomputer (not shown), which is programmed to execute the algorithm and to determine the refrigerant charge level based on inputs from sensors 28, 30, 32, 34. Upon initiation of the charge determination algorithm (step 51), sensors 28, 30, 32, 34 are calibrated (step 53). If the sensor calibration (step 55) is not okay, a "sensor fault" condition is indicated, pursuant to step 57. If the sensor calibration is okay, the service technician or other user is directed to install the sensors on the unit, pursuant to step 59. The algorithm then prompts the service technician to input information on the air conditioning system, including the model number of the outdoor unit and the type of expansion device, pursuant to step 61. The algorithm also directs the user to verify that the unit is operating (step 63) and prompts the user to select "YES" when ready to proceed with the charge level determination test, pursuant to step 65.

The program will then begin to record the values of liquid refrigerant temperature $T_{liqv}$, liquid refrigerant pressure $P_{liqv}$, vapor refrigerant temperature $T_{suct}$ and vapor refrigerant pressure $P_{suct}$ for a predetermined time period, using inputs from sensors 28, 30, 32, 34, respectively. The temperature and pressure measurements are taken and recorded (step 67) and the subcooling and superheat values are computed according to step 69 until the system reaches steady-state operation, pursuant to steps 71 and 73. When steady-state operation has been achieved, average values are calculated for the subcooling and superheat parameters, pursuant to step 75. If the computed values are within predetermined acceptable limits for normal unit operation (step 77), refrigerant charge level (CL) is predicted based on the computed values for subcooling (SC) and superheat (SH) and the inputs from pressure sensors 30, 34 ($P_{liqv}$, $P_{suct}$) pursuant to step 81. If the predicted charge level is within a predetermined desired range (e.g., between 98% and 102% of normal charge level), pursuant to step 83, "charge OK, charging complete" is indicated to the user, pursuant to step 85. However, if the predicted charge level is outside of the desired range (step 83), the offset from normal charge level is computed and a charge level adjustment is indicated to the user, pursuant to step 87. Therefore, the algorithm not only determines the refrigerant charge level, but also prompts a service technician or other user to add or subtract refrigerant charge to bring the charge level within acceptable limits.

Figure 6:
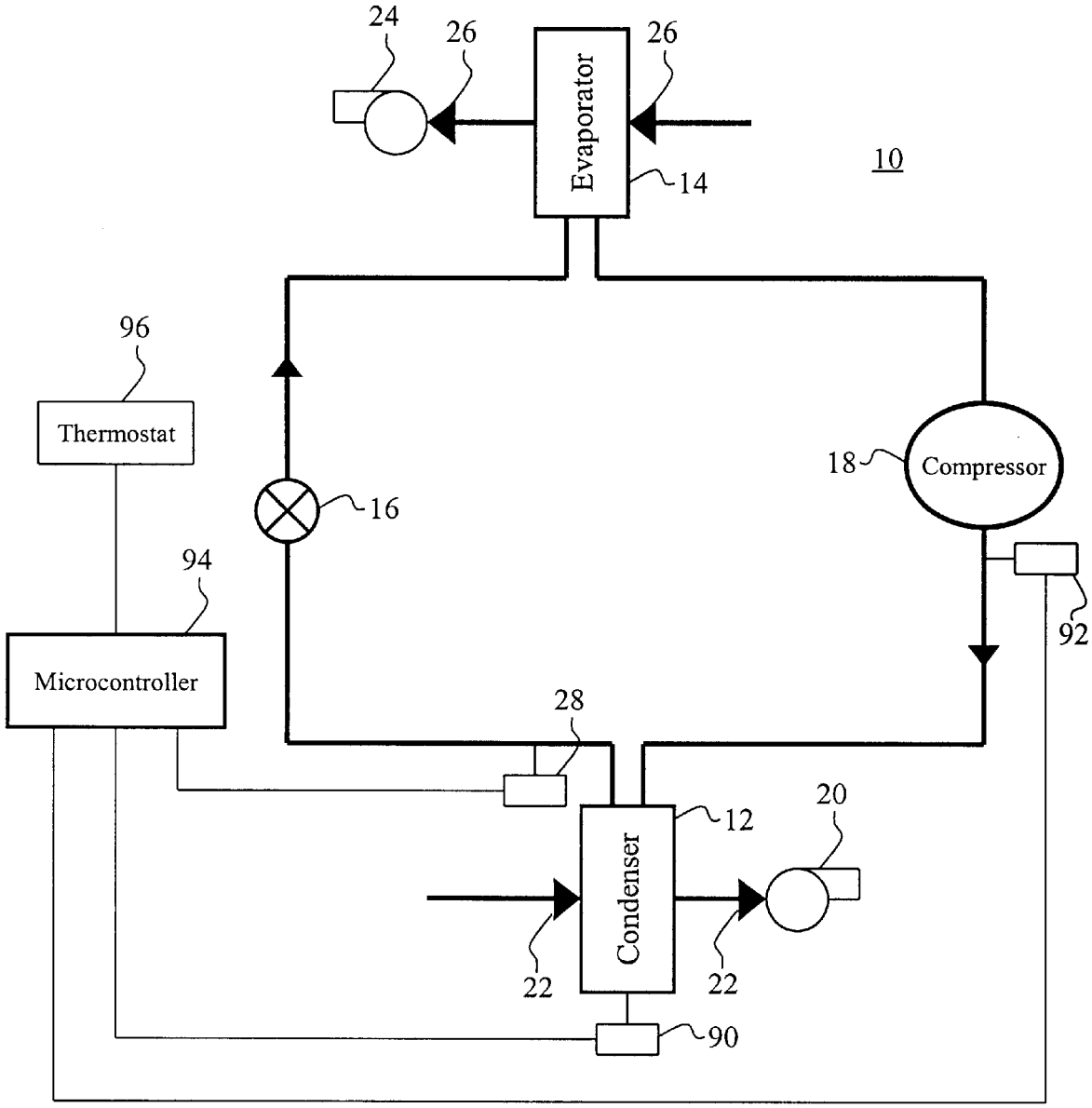
FIG. 6 is a block diagram of an alternate embodiment of a space temperature conditioning system, according to the present invention.

Referring now to FIG. 6, an alternate embodiment of air conditioning system 10 is depicted, with only temperature sensors 28, 90, 92 being required to measure the data for determining refrigerant charge level. Sensor 90 measures refrigerant temperature within condenser 12 ($T_{cc}$) and temperature sensor 92 measures the vapor refrigerant temperature on the discharge side of compressor 18 ($T_{dsc}$). Subcooling (SC) is computed by subtracting the liquid refrigerant temperature $T_{liqv}$ measured by sensor 28 from the condenser refrigerant temperature ($T_{cc}$) measured by sensor 90, according to the following equation (6):

$$SC=T_{cc}-T_{liqv} \quad (6)$$

The superheat value (SH) is determined by subtracting the condenser refrigerant temperature $T_{cc}$ from the compressor discharge refrigerant temperature ($T_{dsc}$) measured by sensor 92 according to the following equation (7):

$$SH=T_{dsc}-T_{cc} \quad (7)$$

In accordance with the alternate embodiment of FIG. 6, pressure sensors are not needed to establish the subcooling and superheat values. Further, FIG. 6 shows a microcontroller 94 that receives inputs from sensors 28, 90, 92 and is programmed to compute refrigerant charge level based on inputs from these three sensors. Microcontroller 94 is also configured to receive an input from an indoor space thermostat 96 for controlling the temperature of the indoor space. Microcontroller 94 can be programmed to provide a visual or audible indication of an abnormal refrigerant charge level to alert an occupant of the space or service technician to the abnormal condition. Alternatively, microcontroller 94 can communicate with a personal digital assistant, either by hard-wire connection or wireless connection. In accordance with yet another embodiment of the invention, microcomputer 94 can communicate with a service technician's computer system via internet connection or modem connection, or by any other appropriate electronic or electromagnetic communication means.

The best mode for carrying out the invention has now been described in detail. Since changes in and additions to the above-described best mode may be made without departing from the nature, spirit or scope of the invention, the invention is not to be limited to the above-described best mode, but only by the appended claims and their proper equivalents.

What is claimed is:

1. In a space temperature conditioning system having a refrigerant as a heat transfer medium, a method of determining refrigerant charge level, comprising the steps of:

establishing a relationship between at least one system operating parameter and refrigerant charge level, independent of ambient temperature conditions;

operating the space temperature conditioning system;

measuring said at least one system operating parameter while the system is in operation; and determining refrigerant charge level based on said relationship in response to said measuring.

2. The method of claim 1 wherein said establishing comprises:

operating the system;

measuring said at least one system operating parameter under a plurality of ambient temperature conditions for each of a plurality of known refrigerant charge levels; and correlating the measured values of said at least one system operating parameter to establish a relationship between refrigerant charge level and said at least one system operating parameter, independent of the ambient temperature conditions.

3. The method of claim 2 further including comparing a determined refrigerant charge level to actual charge level for each of a plurality of ambient temperature conditions, to validate said correlating.

4. The method of claim 1 wherein said system is a space temperature conditioning system of the type having a condenser, an evaporator and a compressor for circulating a vapor compression refrigerant between the evaporator and the condenser, said at least one said system operating parameter including a refrigerant subcooling parameter.

5. The method of claim 1 wherein said system is a space temperature conditioning system of the type having a condenser, an evaporator and a compressor for circulating a vapor compression refrigerant between the evaporator and the condenser, said at least one said system operating parameter including a refrigerant subcooling parameter and a refrigerant superheat parameter.

6. The method of claim 1 wherein said system is a space temperature conditioning system of the type having a condenser, an evaporator and a compressor for circulating a vapor compression refrigerant between the evaporator and the condenser, said at least one said system operating parameter including a refrigerant subcooling parameter, a refrigerant superheat parameter and a refrigerant pressure parameter.

7. The method of claim 1 wherein said system is a space temperature conditioning system of the type having a condenser, an evaporator and a compressor for circulating a vapor compression refrigerant between the evaporator and the condenser, said at least one said system operating parameter including a refrigerant subcooling parameter and a refrigerant pressure parameter.

8. The method of claim 1 wherein said operating comprises the step of operating the system at a relatively steady-state condition.

9. In a space temperature conditioning system having a condenser, an evaporator and a compressor for circulating a vapor compression refrigerant between the evaporator and the condenser, a method of determining refrigerant charge level, comprising the steps of:

establishing a relationship between refrigerant charge level and a plurality of system operating parameters for a plurality of known refrigerant charge levels, independent of ambient temperature conditions;

operating the system;

measuring said plurality of system operating parameters while the system is in operation;

determining the refrigerant charge level based on said relationship in response to said measuring.

10. The method of claim 9 wherein said establishing comprises:

operating the system;

measuring said plurality of system operating parameters under a plurality of ambient temperature conditions for each of a plurality of known refrigerant charge levels; and correlating the measured values of said plurality of system operating parameters to establish a relationship between refrigerant charge level and said plurality of system operating parameters, independent of the ambient temperature conditions.

11. The method of claim 10 further including comparing a determined refrigerant charge level to actual charge level for each of a plurality of ambient temperature conditions, to validate said correlating.

12. The method of claim 9 wherein said system is a space temperature conditioning system of the type having a condenser, an evaporator and a compressor for circulating a vapor compression refrigerant between the evaporator and the condenser, said plurality of system operating parameters including refrigerant subcooling and refrigerant superheat.

13. The method of claim 12 wherein said plurality of system operating parameters further include refrigerant pressure at a selected location in the system.

14. The method of claim 9 wherein said system is a space temperature conditioning system of the type having a condenser, an evaporator and a compressor for circulating a vapor compression refrigerant between the evaporator and the condenser, said plurality of system operating parameters including refrigerant subcooling and refrigerant pressure at a selected location in the system.

15. The method of claim 9 wherein said system is a space temperature conditioning system of the type having a condenser, an evaporator and a compressor for circulating a vapor compression refrigerant between the evaporator and the condenser, said plurality of system operating parameters including refrigerant subcooling, refrigerant pressure at a first selected location in the system and refrigerant pressure at a second selected location in the system.

16. The method of claim 15 wherein said plurality of system operating parameters further include refrigerant superheat.

17. The method of claim 9 wherein said operating comprises operating the system at a relatively steady-state condition.

18. In a space temperature conditioning system having a condenser, and an evaporator and a compressor for circulating a vapor compression refrigerant between the evaporator and the condenser, a method of determining refrigerant charge level, comprising the steps of:

establishing a relationship between refrigerant charge level and at least first, second and third system operating parameters for a plurality of known refrigerant charge levels, independent of ambient temperature conditions, said first system operating parameter corresponding to refrigerant subcooling, said second system operating parameter corresponding to refrigerant pressure at a selected location on a discharge side of the condenser, said third system operating parameter corresponding to refrigerant pressure at a selected location on a suction side of the compressor;

operating the system to cool air passing through the evaporator;

measuring said first, second and third system operating parameters while the system is in operation; and determining refrigerant charge level based on said relationship in response to said measuring.

19. The method of claim 18 wherein said establishing further includes establishing a relationship between refrigerant charge level and a fourth system operating parameter for a plurality of known refrigerant charge levels, independent of ambient temperature conditions, said fourth system operating parameter corresponding to refrigerant superheat.

20. The method of claim 19 wherein said establishing comprises:

operating system to cool air passing through the evaporator;

measuring said first, second, third and fourth system operating parameters under a plurality of ambient temperature conditions for each of said plurality of known refrigerant charge levels; and correlating the measured values of said first, second, third and fourth system operating parameters to establish a relationship between refrigerant charge level and said first, second, third and fourth system operating parameters, independent of the ambient temperature conditions.

* * * * *